US010864756B2

(12) United States Patent
Estella et al.

(10) Patent No.: US 10,864,756 B2
(45) Date of Patent: Dec. 15, 2020

(54) MARK MITIGATING DEVICE

(71) Applicant: HEWLETT-PACKARD DEVELOPMENT COMPANY, L.P., Spring, TX (US)

(72) Inventors: Albert Estella, Sant Cugat del Valles (ES); Marta Tua Sarda, Sant Cugat del Valles (ES); Bhishma Hernandez Martinez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,167

(22) PCT Filed: Jun. 28, 2017

(86) PCT No.: PCT/US2017/039659
§ 371 (c)(1),
(2) Date: Sep. 27, 2019

(87) PCT Pub. No.: WO2019/005028
PCT Pub. Date: Jan. 3, 2019

(65) Prior Publication Data

US 2020/0101770 A1 Apr. 2, 2020

(51) Int. Cl.

| | |
|---|---|
| ***B41J 11/13*** | (2006.01) |
| ***B41J 29/02*** | (2006.01) |
| ***B41J 29/13*** | (2006.01) |

(52) U.S. Cl.
CPC ..... *B41J 11/13* (2013.01); *B41J 29/02* (2013.01); *B41J 29/13* (2013.01)

(58) Field of Classification Search
CPC ... B41J 11/13; B41J 29/02; B41J 29/13; B41J 29/10
See application file for complete search history.

(56) References Cited

U.S. PATENT DOCUMENTS

| | | | |
|---|---|---|---|
| 3,997,265 | A | 12/1976 | Menon et al. |
| 5,517,218 | A | 5/1996 | Lehna et al. |
| 5,709,382 | A | 1/1998 | Shima |
| 6,471,202 | B1 | 10/2002 | Sugimura |
| 9,160,892 | B1 | 10/2015 | Shelhart et al. |

(Continued)

FOREIGN PATENT DOCUMENTS

| | | | |
|---|---|---|---|
| CN | 1085848 | A | 4/1994 |
| CN | 1907721 | A | 2/2007 |

(Continued)

OTHER PUBLICATIONS

IP.com search (Year: 2020).*

(Continued)

*Primary Examiner* — Lisa Solomon
(74) *Attorney, Agent, or Firm* — HP Inc. Patent Department

(57) ABSTRACT

A mark mitigating device for a printing device has a protector sheet to cover ribs of a printer platen of the printer device to prevent the ribs from causing marks on print media. The mark mitigating device further has a fixing system to fixate the mark mitigating device relative to the printer platen. The protector sheet has an opening to pass through vacuum applied by the printer platen to attract print media.

14 Claims, 4 Drawing Sheets

(56) References Cited

U.S. PATENT DOCUMENTS

| | | | | |
|---|---|---|---|---|
| 9,469,081 | B2 | 10/2016 | Hill et al. | |
| 2013/0201244 | A1* | 8/2013 | Benedicto | B41J 2/175 347/19 |
| 2014/0283701 | A1 | 9/2014 | Lewis et al. | |

FOREIGN PATENT DOCUMENTS

| | | | |
|---|---|---|---|
| CN | 101331024 | A | 12/2008 |
| CN | 202319263 | U | 7/2012 |
| CN | 106739552 | A | 5/2017 |
| JP | S59103785 | A | 6/1984 |
| JP | 2010064322 | A | 3/2010 |
| JP | 2013040821 | A | 2/2013 |

OTHER PUBLICATIONS

HPDC, "Latex 300 Printer Series, User's Guide," Copyright 2015 HPDC, L.P., 184 p. < https://davinci-technologies.com/wp-content/uploads/2017/04/HP_Latex_300_Series_User_Manual.pdf >.

HPDC, "New Output Platen Protector Available for HP Latex 330, HP Latex 360 and HP Latex 370 Printers," Dec. 14, 2015, 2 p. < http://h20435.www2.hp.com/t5/HP-Latex-300-Series/New-Output-Platen-Protector-Available-for-HP-Latex-330-HP-Latex/ba-p/294468 >.

HPDC, "International Search Report and Written Opinion," May 17, 2018, PCT App. No. PCT/US2017/039659, 6 p.

* cited by examiner

MARK MITIGATING DEVICE

BACKGROUND

Some printer devices have a print zone equipped with a printer platen that has protruding ribs to support print media. The ribs can cause marks, e.g. scratches, on sensible print media when the print media advance through the print zone.

BRIEF DESCRIPTION OF THE DRAWINGS

Examples will be described, by way of example only, with reference to the accompanying drawings in which corresponding reference numerals indicate corresponding parts and in which.

Figure 1:
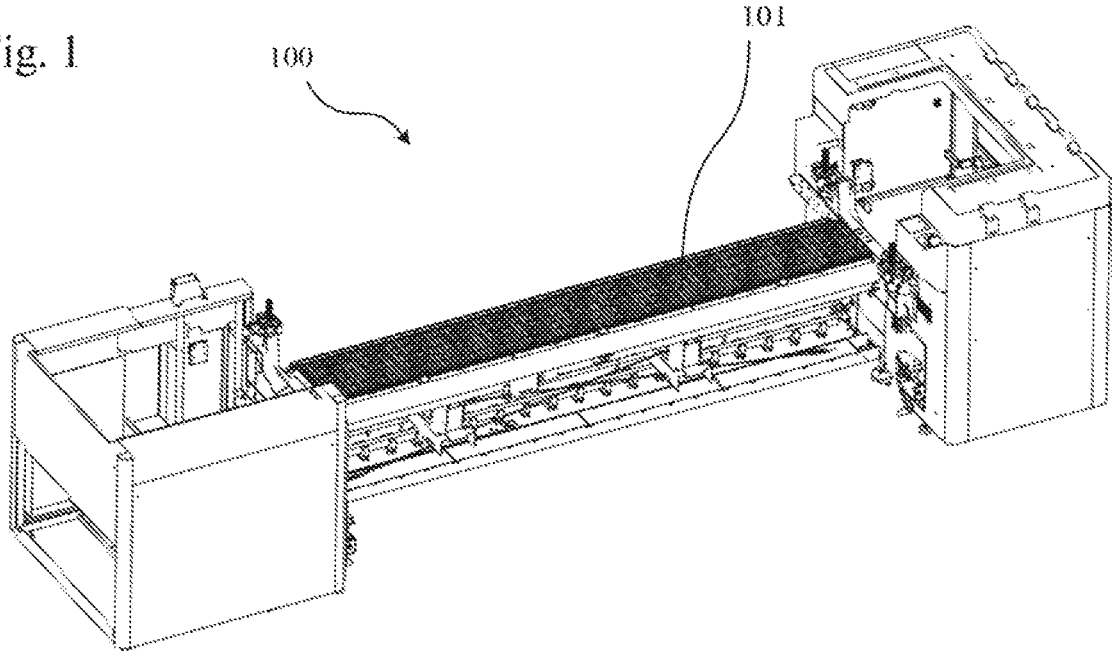
FIG. 1 illustrates a schematic overview of an example printer device.

Moreover the drawings provide examples and/or implementations consistent with the description; however, the description is not limited to the examples and/or implementations provided in the drawings.

DETAILED DESCRIPTION

The description refers to a mark mitigating device for a printing device. The description also refers to a printing device comprising the mark mitigating device and a method of installing the mark mitigation device at the printer device.

An example mark mitigating device for a printing device has a protector sheet to cover ribs of a printer platen of the printer device to prevent from causing marks on print media by the ribs. The mark mitigating device further has a fixing system to fixate the mitigating device relative to the printer platen. The protector sheet has one or more openings to pass through vacuum applied by the printer platen to attract print media.

An example printer device has a printer platen. The printer platen has holes to apply a vacuum to attract print media. The printer platen has ribs to support print media. The printer device further has a mark mitigating device that has a protector sheet to cover the ribs to prevent from causing marks on print media by the ribs. The mark mitigating device further has a fixing system to fixate the mitigating device relative to the printer platen. The protector sheet has one or more openings to pass through the vacuum.

In an example method of installing a mark mitigation device at printer device, a printer device has a printer platen, wherein the printer platen has holes to apply a vacuum to attract print media and ribs to support print media. The mark mitigating device has a protector sheet to cover the ribs to prevent from causing marks on print media by the ribs. The mark mitigating device further has a fixing system to fixate the mitigating device relative to the printer platen. The protector sheet has an opening to pass through the vacuum applied by the printer platen to attract print media. The method includes situating the protector sheet over the printer platen and fixating the protector sheet relative to the printer platen by the fixing system.

In some examples, the printer platen is arranged in a print zone of the printer device. For example, the printer platen is arranged along the (possible) printing positions of a print head of the printer device. The printer platen has ribs protruding from a surface of the printer platen to support the print media. The ribs can control de-wrinkle of the media created during printing, as an effect of temperature and ink humidity, for example. Controlling wrinkle during a printing job allows for increasing image print quality. In some examples, the printer device is an inkjet printer, e.g. with one or more scanning type inkjet print heads. In some examples, the printer platen is arranged under the print head and/or the print head's scanning path, i.e. in a vertical direction opposite to the print head from a perspective of the print media currently being printed on.

In some examples, the mark mitigating device is mountable and dismountable to the printer device by a single operator of the printer device. For example, this allows the operator of the printer device for easily install the mark mitigating device to the printer device in order to print sensible print media as well as to easily uninstall the mark mitigating device from the printer device, e.g. for printing less sensible print media. The mark mitigation device does not restrict the versatility or capability of the printer device of handling different types of print media. Rather, the mark mitigating device enhances the capability of the printer device with regard to mark-sensible (e.g. scratch-sensible) print media. The mark mitigating device can represents an accessory that the operator installs before specific jobs with sensitive media, and after it, can be removed and return the printer device to its initial media control, working as usual (i.e. without the mark mitigating device), for example.

In a situation when the mark mitigating device is not mounted to the printer device, friction of the print media can be reduced in that a contact surface between the print media and the printer platen is the top most portion of the ribs, for example. The ribs may also prevent from the print media adhering to the printer platen in case of ink soaking the print media to its back, i.e. the side of the print media opposite the side currently being printed on. The print media can advance through the print zone between the print head and the printer platen and the printer platen supports the print media when performing printing, for example.

In a situation when the mark mitigating device is mounted to the printer device, the mark mitigating device allows for covering the ribs of the printer platen by the protector sheet of the mark mitigating device. The protector sheet protects against marks on sensible print media otherwise caused by the ribs. This enhances the capability of the printer device to print on print media with sensible coatings, for example. For example, the mark mitigating device is arranged on top of the printer platen. The protector sheet forms an additional layer between the print media and the ribs and provides an increased support area for supporting the print media in comparison with the ribs. This reduces the risk of generating marks on sensible print media.

The printer platen has one or more holes to apply a vacuum to attract print media towards the printer platen. The vacuum helps to hold down print media, supports appropriate alignment of the print media and/or prevents the print media from curling and/or wrinkling, for example. The protector sheet of the mark mitigating device has one or more openings, e.g. holes, in the protector sheet, to pass the vacuum through the protector sheet towards the print media.

This allows for maintaining the vacuum's effect on the print media even with the mark mitigating device being installed at the printer device. In order to (e.g. completely) cover the ribs, in some examples, the openings of the protector sheet are placed at positions other than positions corresponding to the ribs, e.g. at positions in between of directly neighboring ribs.

In some examples, an optical media advance sensor is arranged at the printer platen to monitor advance of print media. For example, the printer platen is equipped with one or more optical media advance sensors (hereinafter OMAS). For example, the printer device can determine, by the OMAS, media advance, e.g. the distance moved during the media advance. In some examples, errors with regard to the media advance can be corrected, by the printer device, in real time based on information obtained by the OMAS. In some examples, the printer device recognizes, by the OMAS, (already) printed registration marks on the print media, e.g. to ensure correct registration from side to side on dual side prints. In some examples, the printer platen includes multiple platens, including one or more platens carrying an OMAS and one or more OMAS-free platens, i.e. platens not carrying an OMAS.

In some examples, the protector sheet has one or more windows to monitor advance of print media through the window by one or more OMAS. The windows of the protector sheet allow for the OMAS to maintain monitoring the advance of print media (even with the mark mitigating device being installed at the printer device). For example, the OMAS can look through the window of the protector sheet to monitor the print media advance.

In some examples, the window for the OMAS is a hole of the protector sheet. In these examples, the protector sheet has at least two kinds of holes, namely the one or more openings for the vacuum and the one or more windows for OMAS. In some other examples, the window for the OMAS includes a transparent portion of the protector sheet, e.g. a transparent polycarbonate section.

In some examples, the window for the OMAS has a structural shape that corresponds to a contour of the OMAS. This enables the operator to easily align the protector sheet relative to the printer platen when mounting the mark mitigating device. For example, the one or more windows of the protector sheet have a relief and/or shape that allows for catching the one or more OMAS to easily align the protector sheet relative to the printer platen.

In some examples, the method of installing the mark mitigation device at the printer device further includes aligning the protector sheet by taking one or more optical media advance sensor and one or more windows as reference.

In some examples, the opening for the vacuum has a slit, e.g. the opening has a slit shape. A vacuum throughput can be increased in that in some examples the slit extends along a direction of the ribs (i.e. in a direction along a short side of the protector sheet), whereas a slit width is smaller than the distance between two neighboring ribs. For example, the width of the opening corresponds to a clearance between neighboring ribs of the printer platen. This allows for increasing the vacuum throughput while maintaining complete coverage of the ribs, for example. In some examples, the protector sheet has two, three or more than three openings arranged in a series in a direction along the ribs. In some examples, the series of two, three or more openings substantially extends over the width of the protector sheet with narrow bars of protector sheet material on each side of the series at the protector sheet length side and narrow bars of protector sheet separating neighboring openings of the series.

In general, a series of openings of the protector sheet means that each pair of openings of the series is separated by a bar of protector sheet material.

In some examples, the protector sheet has multiple openings (for the vacuum) arranged in a series in a direction transverse to the ribs. For example, the protector sheet has two or three or more than three essentially parallel series of openings in the direction transverse to the ribs, i.e. in a direction along the length side of the protector sheet. For example, the positions of the bars (separating the series of openings in the direction transverse to the ribs) correspond to the positions of the ribs. When the mark mitigating device is mounted to the printer device, these bars cover the ribs while the series of openings maintain the vacuum's effect on the print media in between the ribs.

In some examples, the protector sheet has matrix like arranged openings with, for examples, two, three or more parallel series of openings extending transverse to the ribs, i.e. in a direction along the length side of the protector sheet. For example, the openings of the protector sheet form a mesh of openings extending over the protector sheet to uniformly apply the vacuum to the print media in the area of the protector sheet.

As described before, the mark mitigating device has a fixing system to flexibly mount and dismount the mark mitigation device to the printer device, e.g. by the operator of the printer device. This allows the operator to mount the mark mitigating device to the printer device on demand. For example, the mark mitigating device can be mounted to the printer device when printing sensible print media and the mark mitigating device can be dismounted from the printer device when printing less sensible print media.

In some examples, the fixing system has one or more tensioning elements to fasten the mark mitigating device to the printer device. In some of these examples, multiple tensioning elements are arranged at one of the length sides of the mark mitigating device, whereas the fixing system has one or more catches on the opposite length side. This allows for easy installation of the mark mitigating device, for example. In some other examples, multiple tensioning elements are arranged at either length sides of the mark mitigating device. This allows for a symmetric arrangement of the tensioning elements to provide more orientational degrees of freedom for mounting the mark mitigating device relative to the printer platen, for example. In some examples, tensioning elements are pairwise located opposite to each other on opposite length sides of the protector sheet. This can prevent the protector sheet from curling in that tensioning forces applied by the pairs of tensioning elements run in parallel to the ribs, i.e. perpendicular to the length side of the protector sheet.

In some examples, the fixing system has a flange to align the mark mitigating device relative to the printer platen. In some example, the flange is foldable, e.g. to clamp the mark mitigating device to the printer device. In some examples, the flange includes and/or represents a tensioning element as described before.

In some examples, the mark mitigating device has one or more edge holders to hold down the protector sheet towards the printer platen. For example, the edge holder(s) cover(s) a leading edge and/or a trailing edge of the protector sheet. For example, the leading edge is the edge oriented towards a parking position of the printhead. In some examples, the mark mitigation device has two edge holders, which are located on opposite sides, e.g. the leading edge and the trailing edge, of the protector sheet in a direction along a length side of the mark mitigating device. Edge holders can prevent from the print head crashing the mark mitigating device, for example.

In some examples, the mark mitigating device has two separate protector sheets. For example, a length of the protector sheet corresponds to half the length of the printer platen. For example, the length of the protector sheet is 63 inch for a 126 inch length of the platen. One of the two protector sheets can be installed from the left side of the printer device and the other one can be installed from the right side. This simplifies for the operator of the printer system the mounting and dismounting of the mark mitigating device. In some of these examples, the mark mitigating device has an edge holder to be arranged at the boundary between the two protector sheets. In some of these examples, the mitigating device has two further edge holders at the leading edge and the trailing edge of the protector sheet, i.e. it has three edge holders in total, for example.

In some examples, the protector sheet has a thickness of about 0.3 mm, 0.5 mm or 0.8 mm, for example. This allows for installing the mark mitigating device at a printer device without disturbing the printing functionality of the printer device. In some examples, the protector sheet is made of plastic, e.g. polycarbonate.

Now referring to FIG. 1 that shows a schematic overview of an example printer device 100. For illustration purpose, some portions of the printer 100 are not drawn, so a printer platen 101, which extends along a print zone of the printer device 100, becomes visible in FIG. 1. For example, the printer device is for printing on endless print media. In some other examples, the printer device is for printing on single sheet print media. In some examples, the printer device is a scanning type ink jet printer, wherein a print head scans back and forth (e.g. from left to right and vice-versa in FIG. 1) and applies ink to the print media. When printing, print media advance in a direction transverse to the print zone (e.g. from the top to the down in FIG. 1). Turning back to the example printer device 100 shown in FIG. 1, in the print zone the print media are supported by the printer platen 101.

Figure 2:
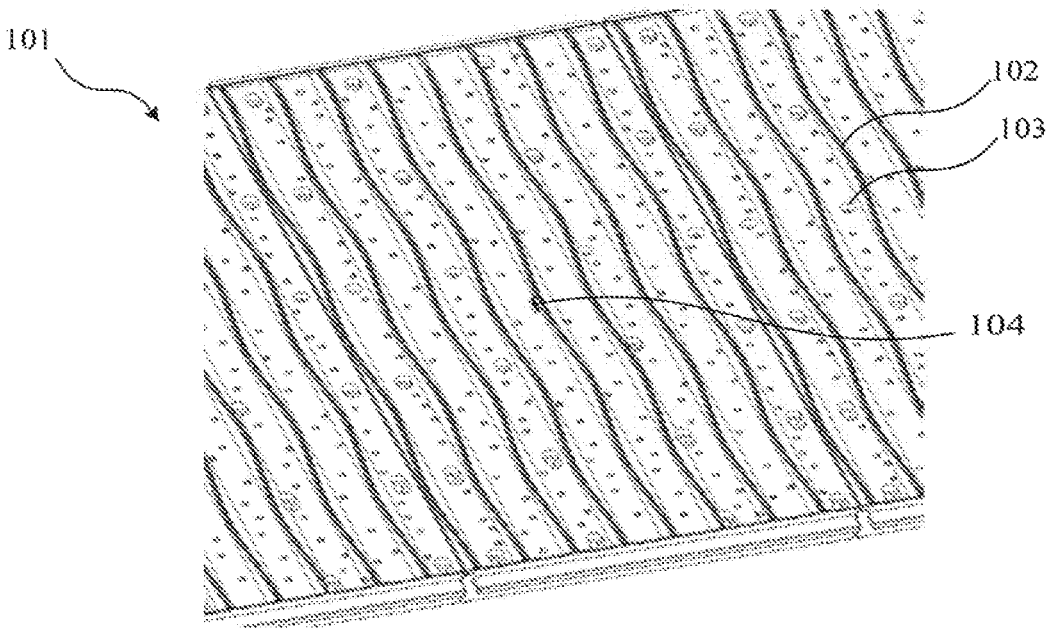
FIG. 2 is a perspective detail enlargement of FIG. 1 illustrating a printer platen of the example printer device.

FIG. 2 shows a perspective detail enlargement of the printer platen 101. The printer platen 101 has holes 103 to apply a vacuum to attract print media towards the printer platen 101 in the print zone. The printer platen 101 further has ribs 102 protruding from the printer platen surface to support print media. This prevents the print media from directly lying on the printer platen surface. For example, the ribs 102 have a serpentine shape as illustrated in FIG. 2. In some other example printer devices, the ribs have a straight line shape. The printer platen 101 shown in FIG. 2 further has an optical media advance sensor (OMAS) 104 to optically monitor advance of print media. In some examples, the OMAS protrudes from the printer platen surface, e.g. by the same height as the height of the ribs 102.

Figure 3:
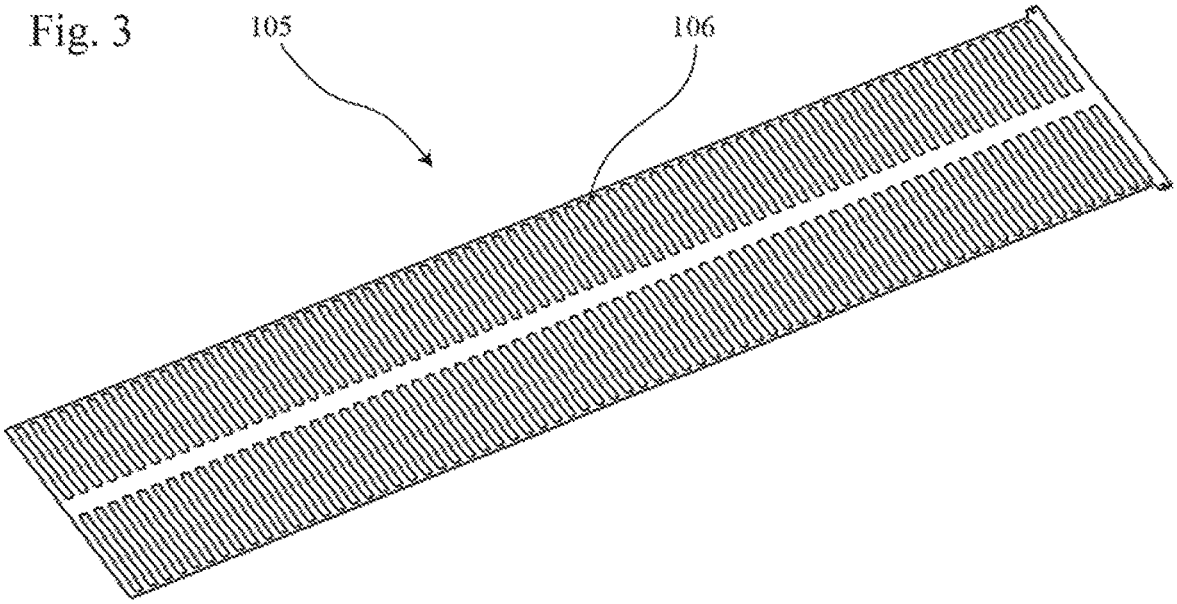
FIG. 3 illustrates a protector sheet of an example mark mitigating device.

A mark mitigating device 105, illustrated in FIG. 3, can be installed at the printer device 100 as described in more detail below. The mark mitigating device 105 has a protector sheet 106 to cover the ribs 102 to prevent from causing marks on print media by the ribs 102. The protector sheet 106 is made of polycarbonate and has a thickness of (about) 0.5 mm.

Figure 4:
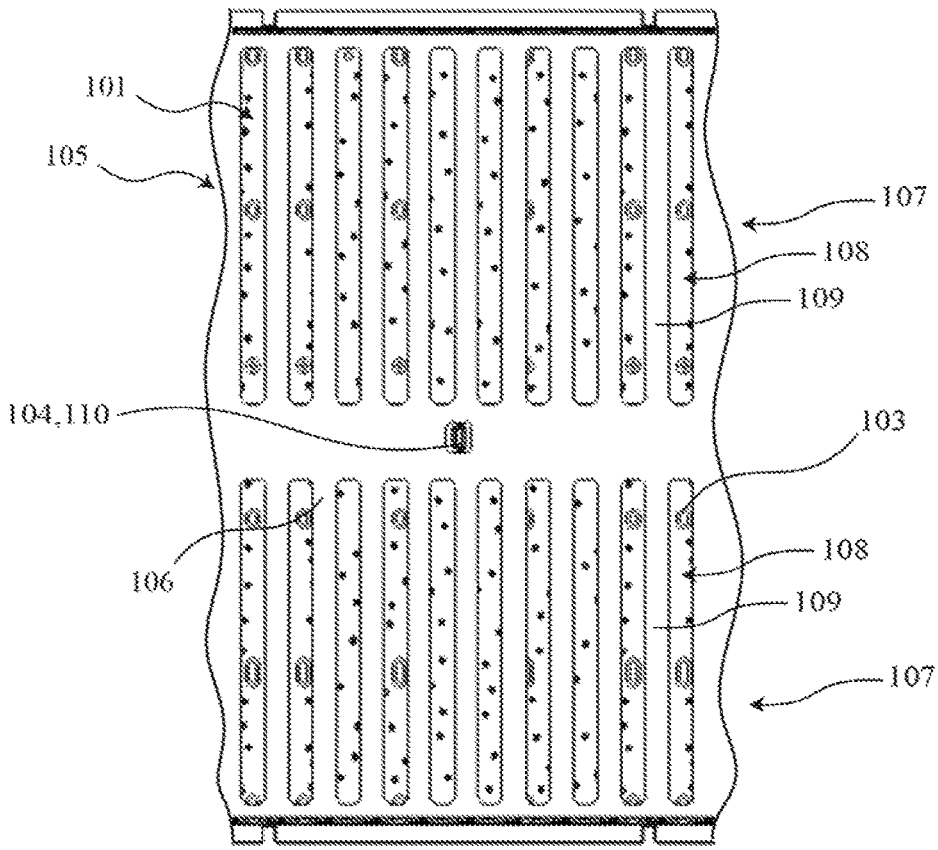
FIG. 4 illustrates a detail enlargement of the protector sheet mounted on the printer platen.

FIG. 4 shows a detail enlargement of the mark mitigating device 105 mounted on top of the printer platen 101. The protector sheet 106 extends over substantially the width of the printer platen 101 (i.e. in the vertical direction in FIG. 4). The protector sheet 106 has two parallel series 107 of openings 108 to pass through the vacuum applied by the holes 102 to attract print media. The parallel series 107 of openings 108 run in a direction of a length side of the protector sheet 106 (i.e. in a horizontal direction in FIG. 4), which corresponds to a length side of the printer platen 106. The openings 108 have a (rectangular) slit shape. Each pair of neighboring openings 108 is separated by a bar 109 of protector sheet material. These bars 109 cover the ribs 102 when the mark mitigating device 105 is installed at the printer device 100. The width of the bars 109 correspond to a maximum extend of the serpentine shaped ribs 102 in a direction perpendicular to the ribs 102, for example. The width of the openings 108 correspond to a clearance, i.e. minimum distance, between neighboring ribs 102, for example.

The protector sheet 106 further has a window 110 for the OMAS 104. This enables the OMAS 104 to monitor the advance of print media through the window 104 when the mark mitigating device 105 is installed at the printer device 100.

Figure 5A:
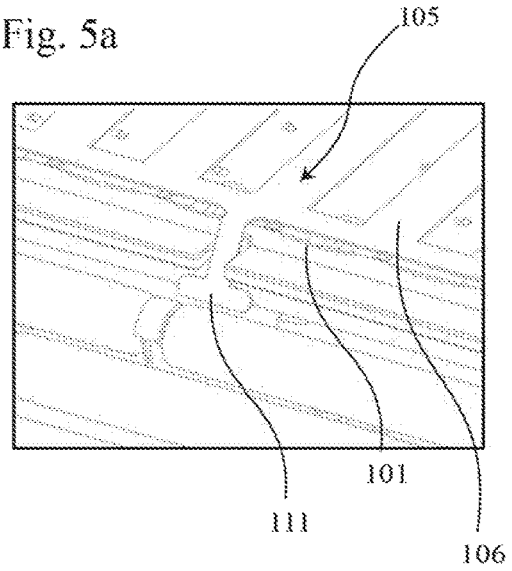
FIG. 5*a* and FIG. 5*b* illustrate a fixation system of the mark mitigating device.
Figure 5B:
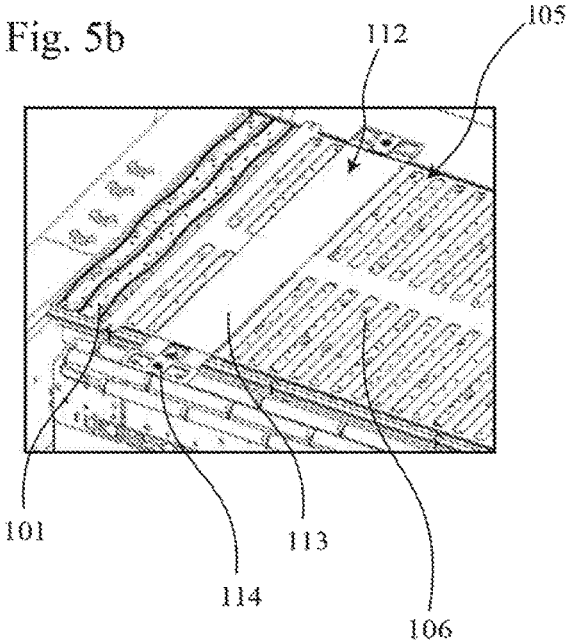

As illustrated in FIG. 5*a* and FIG. 5*b*, the mark mitigating device 105 has a fixing system to fixate the mark mitigating device 105 relative to the printer platen 101. The fixing system has foldable flanges 111 to align the mark mitigating device relative to the printer platen 101 and to apply tension to the protector sheet 106 to fixate the protector sheet 106 at the printer platen 101. For example, the flanges 111 can be snapped in a recess of the printer platen 101 as illustrated in FIG. 5*a*. The fixing system further has edge holders 112 to hold down the protector sheet 106 towards the printer platen 101 as illustrated in FIG. 5*b*. For example, the edge holder 112 has a belt 113 to cover the leading or trailing edges of the protector sheet 106 and tensioners 114 on either side of the belt 113 to apply tensioning forces to hold down the protector sheet 106.

Figure 6:
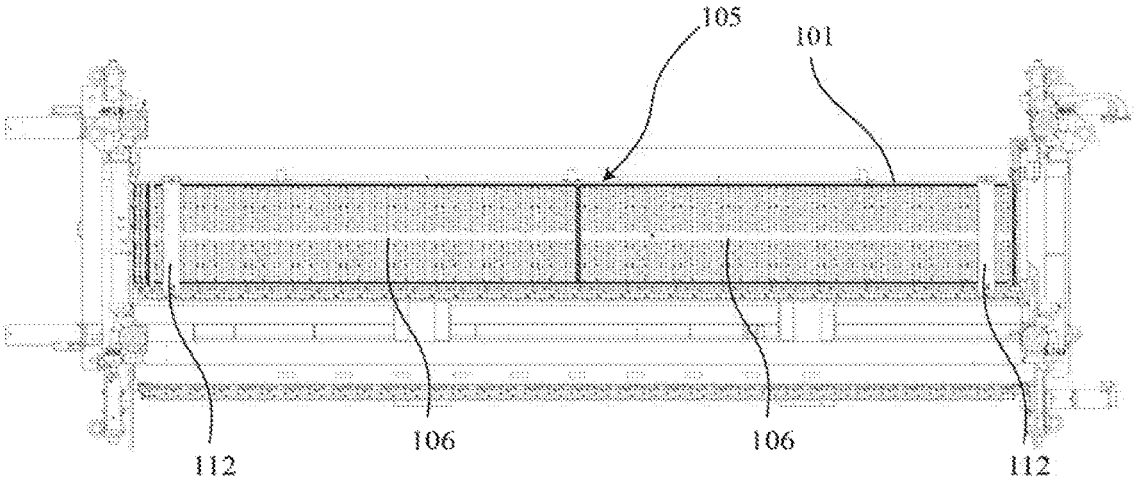
FIG. 6 illustrates a two-piece protector sheet example of a mark mitigating device.

As illustrated in FIG. 6, the example mark mitigating device 105 has two protector sheets 106 each covering one half of the printer platen 101, i.e. each protector sheet 106 has a length which corresponds to half the length of the printer platen 101. Such a two-piece protector sheet mark mitigating device makes it easier for the operator of the printer device 100 to install and de-install the mark mitigating device 105, for example. FIG. 6 further illustrates respective edge holders 112 at either short side of the pair of protector sheets 106. In some other examples, the mark mitigating device has a single protector sheet that has substantially the same length as the printer platen.

Figure 7:
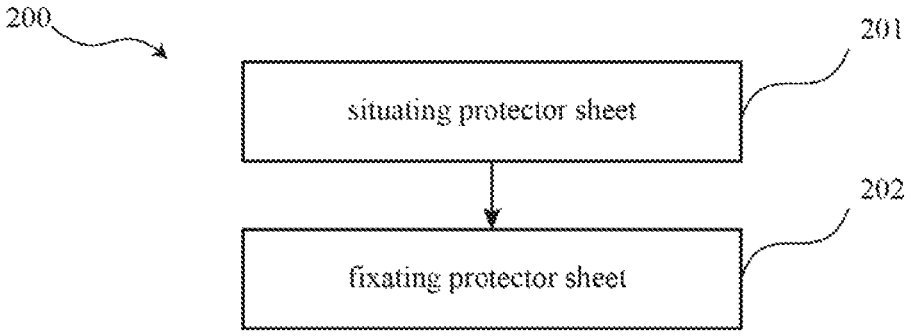
FIG. 7 schematically illustrates a method of installing the mark mitigating device to the printer platen.

FIG. 7 schematically illustrates an example method 200 of installing the mark mitigation device 105 at the example printer device 100 described with regard to FIG. 1-6. The method 200 includes, in box 201, situating the protector sheet 105 over the printer platen 101. In some examples, the two-piece protector sheet, i.e. the two protector sheet(s) 105 having half the length of the printer platen 101, makes it easier for the operator to handle the protector sheet(s) 105 for situating them over the printer platen 101.

The example method 200 further includes, in box 202, fixating the protector sheet(s) 106 relative to the printer platen 101 by the fixing system. In some examples, this includes snapping the bendable flanges 111 into corresponding recesses of the printer platen 101. In some examples, the method further includes attaching one, two or three edge holders to the printer platen at the protector sheet(s) short sides.

In some example methods of installing the mark mitigating device 105 to the printer device 100, the method further includes aligning the protector sheet 106 by taking the OMAS 104 and the window 110 as references for alignment.

In some examples, the shape of the windows 110 is a hole in the protector sheet 106 and the hole's shape corresponds to the contour of the OMAS 104. In some examples, the method of installing the mark mitigation device 105 at the example printer device 100 further includes (slightly) pushing down the protector sheet 106, e.g. by a fingertip, nearby the windows 110 to catch the OMAS 104 with the window 110. By catching the OMAS 104 with the windows 110 the protector sheet 106 can be aligned relative to the printer platen 101.

A still further example method of de-installing, e.g. by the operator of the printer device 100, the mark mitigating device 105 from the printer device 100 includes removing any edge holders 112 and releasing the bendable flanges 111 and removing the protector sheet 106 from the printer platen 101.

Although some examples of methods and products have been described herein, other variations are generally within the scope of this description. As will be appreciated, the description generally contemplates various implementations fairly falling within the scope of the appended claims either literally or under the doctrine of equivalents.

The invention claimed is:

1. A mark mitigating device for a printing device, the mark mitigating device comprising:

a protector sheet to cover ribs of a printer platen of the printer device to prevent the ribs from causing marks on print media and a fixing system to fixate the mark mitigating device relative to the printer platen, wherein the protector sheet comprises an opening to pass through a vacuum applied by the printer platen to attract print media.

2. The mark mitigating device of claim 1, wherein the protector sheet further comprises a window for an optical media advance sensor arranged at the printer platen to monitor advance of print media through the window.

3. The mark mitigating device of claim 1, wherein the opening comprises a slit, wherein the slit has a slit width that corresponds to a clearance between neighboring ribs of the printer platen.

4. The mark mitigating device of claim 1, wherein the protector sheet comprises multiple of the openings arranged in a series separated by bars of protector sheet material, wherein the bars are to cover the ribs.

5. The mark mitigating device of claim 1, wherein the fixing system comprises a flange to align the mark mitigating device relative to the printer platen, wherein the flange is foldable.

6. The mark mitigating device of claim 1, wherein the fixing system comprises an edge holder to hold down the protector sheet towards the printer platen.

7. The mark mitigating device of claim 1, wherein the protector sheet is made of polycarbonate.

8. The mark mitigating device of claim 1, wherein a thickness of the protector sheet is about 0.5 mm.

9. The mark mitigating device of claim 1, wherein the mark mitigating device comprises two separate protector sheets, each to cover one half of the printer platen.

10. The mark mitigating device of claim 9, wherein a length of each of the two separate protector sheets corresponds to half the length of the printer platen.

11. A printer device comprising:

a printer platen, wherein the printer platen comprises holes to apply a vacuum to attract print media and ribs to support print media; and a mark mitigating device, wherein the mark mitigating device comprises a protector sheet to cover the ribs to prevent the ribs from causing marks on print media and a fixing system to fixate the mark mitigating device relative to the printer platen.

12. The printer device of claim 11, wherein the printer platen comprises an optical media advance sensor arranged at the printer platen to monitor advance of print media, and the protector sheet further comprises a window for the optical media advance sensor to monitor advance of print media through the window.

13. The printer device of claim 11, wherein the printer device is an ink jet printer comprising an ink jet print head, wherein the printer platen is arranged along printing positions of the print head.

14. A method of installing a mark mitigation device on a printer device, wherein the printer device comprises a printer platen, wherein the printer platen comprises holes to apply a vacuum to attract print media, and ribs to support print media;

the mark mitigating device comprises a protector sheet to cover the ribs to prevent the ribs from causing marks on print media and a fixing system to fixate the mark mitigating device relative to the printer platen, wherein the protector sheet comprises an opening to pass through the vacuum applied by the printer platen to attract print media; wherein the method comprises:

situating the protector sheet over the printer platen, and fixating the protector sheet relative to the printer platen with the fixing system.

* * * * *